US006991685B2

(12) United States Patent
Kravitz et al.

(10) Patent No.: US 6,991,685 B2
(45) **Date of Patent: *Jan. 31, 2006**

(54) LOW TEMPERATURE CLEANING

(75) Inventors: Joseph I. Kravitz, Champlin, MN (US); Francis L. Richter, Lino Lakes, MN (US); Duane J. Reinhardt, Maplewood, MN (US); Gerald K. Wichmann, Maple Grove, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/146,540

(22) Filed: Jun. 7, 2005

(65) Prior Publication Data

US 2005/0236017 A1 Oct. 27, 2005

Related U.S. Application Data

(63) Continuation of application No. 10/394,365, filed on Mar. 21, 2003, now Pat. No. 6,953,507.

(51) Int. Cl.
*G08B 3/00* (2006.01)

(52) U.S. Cl. ..... 134/26; 134/22.1; 134/22.11; 134/22.12; 134/22.13; 134/22.16; 134/22.17; 134/22.18; 134/22.19; 134/27; 134/28; 134/29; 134/30; 134/34; 134/35; 134/36; 134/40; 134/41

(58) Field of Classification Search ..... 134/22.1, 134/22.11, 22.12, 22.13, 22.14, 22.16, 22.17, 134/22.18, 22.19, 26, 27, 28, 29, 30, 34, 134/35, 36, 40, 41

See application file for complete search history.

(56) References Cited

U.S. PATENT DOCUMENTS 6,326,032 B1 * 12/2001 Richter et al. ..... 424/616

* cited by examiner

*Primary Examiner*—Sharidan Carrillo
(74) *Attorney, Agent, or Firm*—Andrew D. Sorensen; Anneliese M. Seifert

(57) ABSTRACT

The invention relates to a method of low temperature cleaning and applying an antimicrobial treatment to food and beverage plant equipment. In addition, the method includes carbon dioxide compatible chemistry. The method may be achieved through a multi-step method.

11 Claims, 4 Drawing Sheets

LOW TEMPERATURE CLEANING

This application is a continuation of U.S. patent application Ser. No. 10/394,365, filed Mar. 21, 2003 now U.S. Pat. No. 6,953,507 titled LOW TEMPERATURE CLEANING, the entire disclosure of which is incorporated herein by reference in its entirety.

FIELD OF THE INVENTION

The invention relates to a method of low temperature cleaning and applying an antimicrobial treatment to food and beverage plant equipment. In addition, the method includes carbon dioxide compatible chemistry. The method may be achieved through a multi-step method.

BACKGROUND

In the food and beverage industry, and the carbonated beverage industry in particular, cleaning and sanitizing plant equipment can be very time consuming and costly. The current methods of cleaning and sanitizing plant equipment require very high temperatures up to 185° F. Consequently, time is spent heating and cooling the equipment. Oftentimes, maintaining high temperatures for an entire cleaning and sanitizing program is difficult and can lead to ineffective sanitation of the equipment. Additionally, the high temperatures, coupled with aggressive chemistry, lead to wear and tear on the equipment. Repeated heating and cooling subjects the equipment to thermal stresses that can lead to metal fatigue and breakdown of elastomer gaskets and seals providing a harborage for bacteria. This can then lead to the formation of hard to remove biofilms and undesirable effects on the product. It is especially costly and time consuming to clean beverage plant equipment if carbon dioxide from carbonated beverages is still in the equipment. Typically, when cleaning carbonated beverage plant equipment, the carbon dioxide must be removed from the system before it can be cleaned with a caustic cleaner. If the carbon dioxide is not removed and a caustic detergent with sodium hydroxide is used, the caustic is converted into sodium carbonate by the carbon dioxide. Formation of sodium carbonate causes several problems. It can form a precipitate adding to the soil load if its solubility limit is exceeded. In the presence of hard water, sodium carbonate reacts with the calcium and magnesium ions to form insoluble calcium and magnesium compounds. Further, the conversion of gaseous carbon dioxide to sodium carbonate or sodium bicarbonate can create a vacuum that can destroy vessels by collapsing them. Therefore, a need exists for a method of low temperature cleaning of plant equipment that eliminates the time, cost, and wear and tear on equipment associated with current high temperature cleaning methods. Additionally, a need exists for a method of low temperature cleaning of beverage plant equipment using carbon dioxide compatible chemistry that eliminates the need for removing carbon dioxide when the equipment is being cleaned.

SUMMARY

The invention pertains to a method of cleaning and applying an antimicrobial treatment. More particularly, in one embodiment, the invention pertains to a method of cleaning and applying an antimicrobial treatment comprising optionally rinsing a surface with an initial rinse solution, washing a surface with a detergent wash solution, rinsing a surface with an intermediate rinse solution, applying an antimicrobial treatment solution, and rinsing a surface with a final initial rinse solution. In another embodiment, the invention pertains to a method of cleaning and applying an antimicrobial treatment comprising optionally rinsing a surface with an initial rinse solution, washing a surface with an antimicrobial detergent wash solution, and rinsing a surface with a final rinse solution.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

Definitions

Figure 1:
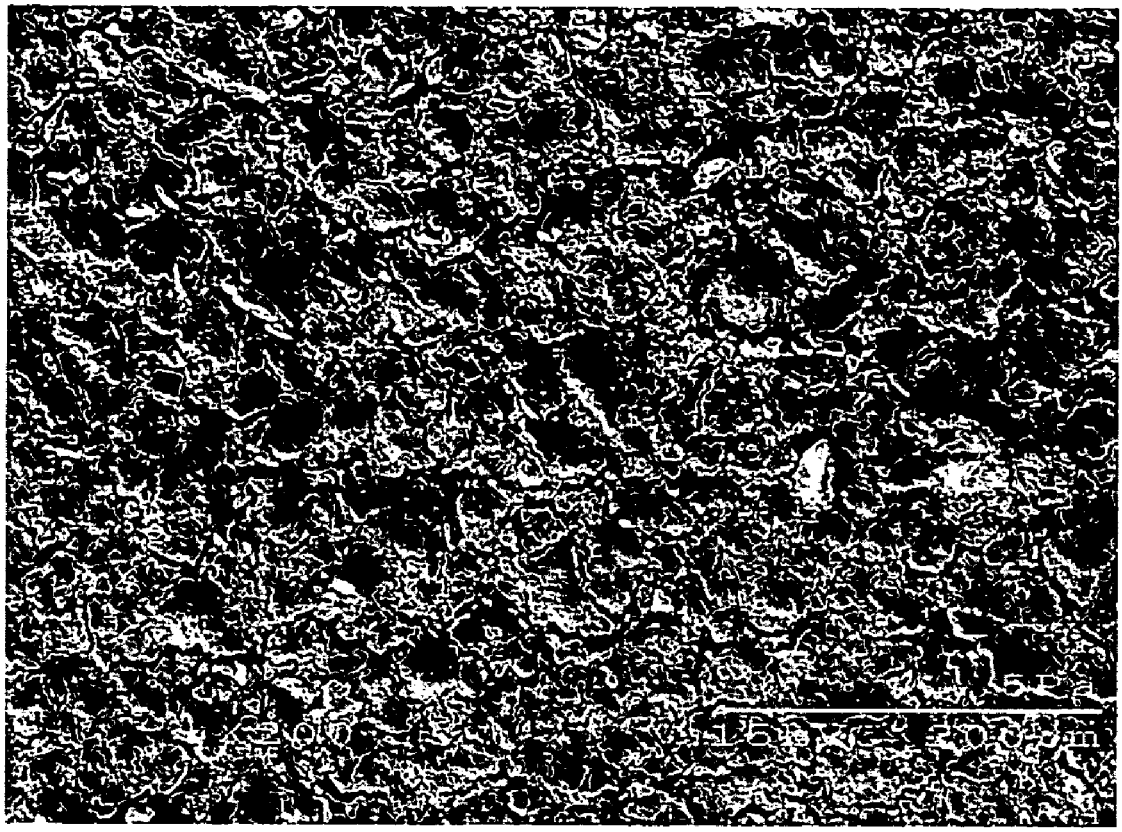
FIG. 1 is an electron micrograph of an elastomer coupon subjected to a pH of 13 at 185° F. for two weeks.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, and the like are synonyms and refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

A "detersive agent" includes a neutral, acidic, or alkaline detersive agent. A neutral detersive agent is one that includes either an acidic detersive agent or a basic detersive agent and appropriate amounts of water and buffer to reach a neutral pH. The neutral detersive agent may also include additional functional ingredients as defined herein. Non-limiting examples of acidic detersive agents include mineral acids such as phosphoric acid, sulfuric acid, nitric acid, and hydrochloric acid, and organic acids such as citric acid, lactic acid, glycolic acid, and acetic acid. The acidic detersive agent is preferably amine free. The acidic detersive agent may include additional functional ingredients as defined herein. Non-limiting examples of alkaline detersive agents include sodium hydroxide and potassium hydroxide. The alkaline detersive agent is preferably non-sodium carbonate precipitating. Non-sodium carbonate precipitating refers to a solution containing carbon dioxide with a sufficiently low degree of alkalinity such that the formation of sodium carbonate will not exceed its solubility limit. The detersive agent preferably maintains a pH between 0–11, more preferably in the range of 1–10, and most preferably in the range of 1–7.

An "antimicrobial agent" includes percarboyxlic acids, halogen compositions or interhalogens thereof, a halogen donor composition, chlorine dioxide, ozone, a quaternary ammonium compound, an acid-anionic organic sulfonate or sulfate, a protonated carboxylic acid, or mixtures thereof. Some non-limiting examples of percarboxylic acids include: $C_1$–$C_{10}$ percarboxylic acids, diperoxyglutaric acid, diperoxyadipic acid, diperoxysuccinic acid, diperoxysuberic acid, diperoxymalonic acid, peroxylactic acid, peroxyglycolic acid, peroxyoxalic acid, peroxypyruvic acid, and mixtures thereof. Some non-limiting examples of halogen compounds and interhalogens thereof include: $Cl_2$, $Br_2$, $I_2$, ICl, IBr, ClBr, $ICl_2^-$, $IBr_2^-$, and mixtures thereof. Non-limiting examples of halogen donor compositions include: HOCl, HOI, HOBr, and the salts thereof; N-iodo, N-bromo, or N-chloro compounds; and N-bromosuccinamide, chloroisocyanuric acid, or 2-N-sodium-N-chloro-p-toluenesulfonamide. A non-limiting example of chlorine dioxide compositions includes chlorine dioxide generated from conventional chemical generators such as those sold by Prominent™ or preferably generated electrochemically using Halox™ generators. A non-limiting example of ozone includes ozone generated electrochemically via high voltage discharge in oxygen. Non-limiting examples of quaternary ammonium compounds include: didecyldimethylammonium chloride, dioctyldimethylammonium chloride, octyldecyldimethylammonium chloride, alkyldimethylbenzylammonium chloride, and mixtures thereof. Non-limiting examples of acid-anionic organic sulfonates and sulfates include: acidic solutions of linear benzylsulfonic acid and sulfonated oleic acid. Non-limiting examples of protonated carboxylic acids include: solutions with a pH less than 5 of one or more $C_1$–$C_{10}$ carboxylic acids. The antimicrobial agent is preferably a percarboxylic acid and most preferably peracetic acid or mixtures of peracetic acid and peroctanoic acid. See U.S. Pat. Nos. 4,051,058, 4,051,059, 5,200,189, 5,200,198, 5,489,434, 5,718,910, 5,314,687, 5,437,868 for further discussion on peracid chemistry and the formation of an antimicrobial agent formulation. These patents are incorporated herein by reference in their entirety.

An "additional functional ingredient" includes wetting agents or surfactants, hydrotropes or couplers, sequestrants or builders, thickeners or viscosity modifiers, defoamers, dyes, enzymes, buffers, and degreasers or solvents.

The "wetting agent" or "surfactant" of the present invention can be selected from water soluble or water dispersible nonionic, semi-polar nonionic, anionic, cationic, amphoteric, or zwitterionic surface-active agents, or any combination thereof. The particular surfactant or surfactant mixture chosen for use in the process and products of this invention can depend on the conditions of final utility, including method of manufacture, physical product form, use pH, use temperature, foam control, and soil type.

A typical listing of the classes and species of surfactants useful herein appears in U.S. Pat. No. 3,664,961 issued May 23, 1972, to Norris.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

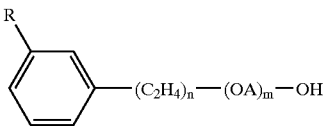

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O)_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$–$C_4$ hydrocarbyl, 2-hydroxy ethyl, 2-hydroxy propyl, ethoxy, propoxy group, or a mixture thereof; $R^2$ is a $C_5$–$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated)

thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$–$C_{18}$ fatty alcohols and $C_6$–$C_{18}$ mixed ethoxylated and propoxylated fatty alcohols are suitable surfactants for use in the present compositions, particularly those that are water soluble. Suitable ethoxylated fatty alcohols include the $C_{10}$–$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R^6CON(R^7)_2$ in which $R^6$ is an alkyl group containing from 7 to 21 carbon atoms and each $R^7$ is independently hydrogen, $C_1$–$C_4$ alkyl, $C_1$–$C_4$ hydroxyalkyl, or $—(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae:

$$R^{20}——(PO)_sN——(EO)_tH,$$

$$R^{20}——(PO)_sN——(EO)_tH(EO)_tH \text{ and}$$

$$R^{20}——N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2–5, t is 1–10, preferably 2–5, and u is 1–10, preferably 2–5. Other variations on the scope of these compounds may be represented by the alternative formula:

$$R^{20}——(PO)_v——N[(EO)_wH][(EO)_zH]$$

in which $R^{20}$ is as defined above, v is 1 to 20 (e.g., 1, 2, 3, or 4 (preferably 2)), and w and z are independently 1–10, preferably 2–5.

These compounds are represented commercially by a line of products sold by Huntsman Chemicals as nonionic surfactants. A preferred chemical of this class includes Surfonic™ PEA 25 Amine Alkoxylate.

Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

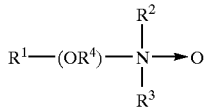

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1–3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

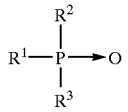

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Semi-polar nonionic surfactants useful herein also include the water soluble sulfoxide compounds which have the structure:

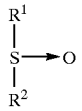

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Generally, however, anionics have high foam profiles which limit their use alone or at high concentration levels in cleaning systems such as CIP circuits that require strict foam control. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia", *Cosmetics & Toiletries*, Vol. 104 (2) 71–86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. Although each of these classes of anionic surfactants can be employed in the present compositions, it should be noted that certain of these anionic surfactants may be incompatible with the enzymes incorporated into the present invention. For example, the acyl-amino acids and salts may be incompatible with proteolytic enzymes because of their peptide structure.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$ alkyl) and -N—($C_1$–$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11–13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

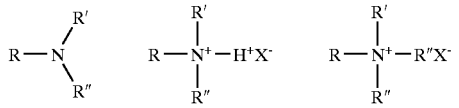

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," *Cosmetics & Toiletries*, Vol. 104 (2) 86–96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

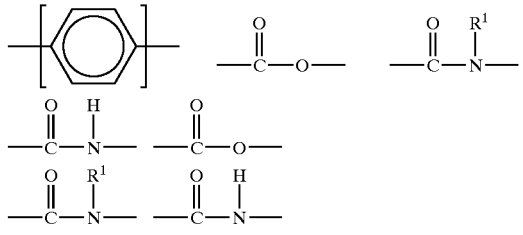

an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

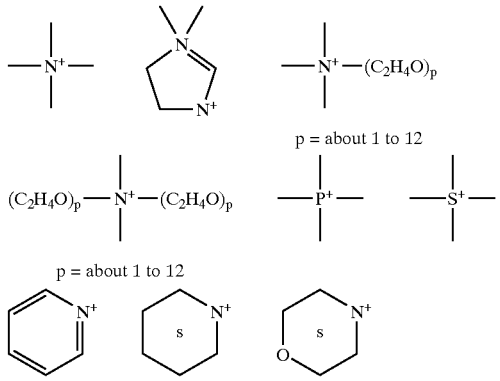

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69–71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

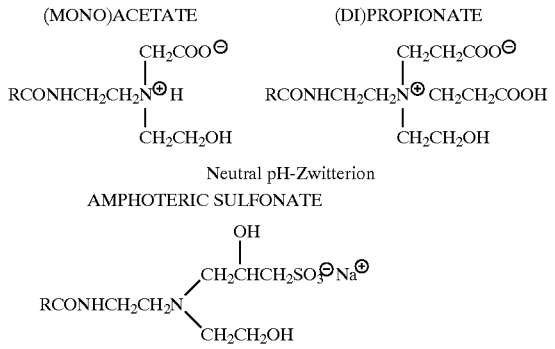

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which $R{=}C_8{-}C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N (2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these R is preferably an acyclic hydrophobic group containing from about 8 to about 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from about 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

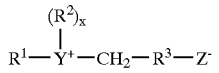

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)- 2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

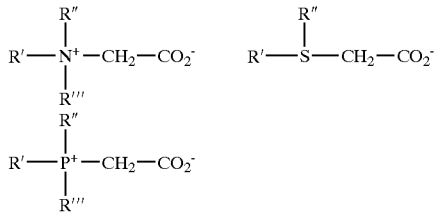

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{1-16}$ acylmethylamidodimethylbetaine.

Sultaines useful in the present invention include those compounds having the formula $(R(R^1)_2N^+R^2SO^{3-}$, in which R is a $C_6$–$C_{18}$ hydrocarbyl group, each $R^1$ is typically independently $C_1$–$C_3$ alkyl, e.g. methyl, and $R^2$ is a $C_1$–$C_6$ hydrocarbyl group, e.g. a $C_1$–$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Surfactant Compositions

The surfactants described hereinabove can be used singly or in combination in the practice and utility of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. The foregoing organic surfactant compounds can be formulated into any of the several commercially desirable composition forms of this invention having disclosed utility. Said compositions are washing or presoak treatments for food or other soiled surfaces in concentrated form which, when dispensed or dissolved in water, properly diluted by a proportionating device, and delivered to the target surfaces as a solution, gel or foam will provide cleaning. Said cleaning treatments consisting of one product, or involving a two product system wherein proportions of each are utilized. Said product is typically a concentrate of liquid or emulsion.

The "hydrotrope" or "coupler" can be used to ensure that the composition remains phase stable and in a single highly active aqueous form. Such hydrotropes or couplers can be used at concentrations that maintain phase stability but do not result in unwanted compositional interaction.

Representative classes of hydrotropes or coupling agents include an anionic surfactant such as an alkyl sulfate, an alkyl or alkane sulfonate, a linear alkyl benzene or naphthalene sulfonate, a secondary alkane sulfonate, alkyl ether sulfate or sulfonate, an alkyl phosphate or phosphonate, dialkyl sulfosuccinic acid ester, sugar esters (e.g., sorbitan esters) and a $C_{8-10}$ alkyl glucoside.

Preferred coupling agents for use in the present compositions and methods include n-octane sulfonate and aromatic sulfonates such as an alkyl aryl sulfonate (e.g., sodium xylene sulfonate or naphthalene sulfonate). Preferred hydrotropes for use in the present compositions and methods include alkylated diphenyl oxide disulfonic acids, such as those sold under the DOWFAX™ trade name, preferably the acid forms of these hydrotropes.

Anionic surfactants useful with the invention include alkyl carboxylates, linear alkylbenzene sulfonates, paraffin sulfonates and secondary n-alkane sulfonates, sulfosuccinate esters and sulfated linear alcohols.

Zwitterionic or amphoteric surfactants useful with the invention include β-N-alkylaminopropionic acids, n-alkyl-β-iminodipropionic acids, imidazoline carboxylates, n-alkyIletaines, amine oxides, sulfobetaines and sultaines.

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants have a diblock polymer including an EO block and a PO block, a center block of polyoxypropylene units (PO), and having blocks of polyoxyethylene grated onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

Also useful in the context of this invention are surfactants including alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as "Plurafac" surfactants. A particular group of alcohol alkoxylates found to be useful are those having the general formula $R—(EO)_m——(PO)_n$ wherein m is an integer of about 2–10 and n is an integer from about 2–20. R can be any suitable radical such as a straight chain alkyl group having from about 6–20 carbon atoms.

Other useful nonionic surfactants include capped aliphatic alcohol alkoxylates. These end caps include but are not limited to methyl, ethyl, propyl, butyl, benzyl and chlorine. Useful alcohol alkoxylates include ethylene diamine ethylene oxides, ethylene diamine propylene oxides, mixtures thereof, and ethylene diamine EO-PO compounds, including those sold under the tradename Tetronic. Preferably, such surfactants have a molecular weight of about 400 to 10,000. Capping improves the compatibility between the nonionic and the oxidizers hydrogen peroxide and peroxycarboxylic acid, when formulated into a single composition. Other useful nonionic surfactants are alkylpolyglycosides.

Another useful nonionic surfactant is a fatty acid alkoxylate wherein the surfactant includes a fatty acid moiety with an ester group including a block of EO, a block of PO or a mixed block or heteric group. The molecular weights of such surfactants range from about 400 to about 10,000, a preferred surfactant has an EO content of about 30 to 50 wt-% and wherein the fatty acid moiety contains from about 8 to about 18 carbon atoms.

Similarly, alkyl phenol alkoxylates have also been found useful in the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably such surfactants have a molecular weight of about 400 to about 10,000 and have from about 5 to about 20 units of ethylene oxide, propylene oxide or mixtures thereof.

A "sequestrant" or "builder" may be included for assisting in controlling mineral hardness. Inorganic as well as organic builders can be used. The level of builder can vary widely depending upon the end use of the composition and its desired physical form.

Inorganic or phosphate-containing detergent builders include alkali metal, ammonium and alkanolammonium salts of polyphosphates (e.g. tripolyphosphates, pyrophosphates, and glassy polymeric meta-phosphates). Non-phosphate builders may also be used. These can include phytic acid, silicates, alkali metal carbonates (e.g. carbonates, bicarbonates, and sesquicarbonates), sulphates, aluminosilicates, monomeric polycarboxylates, homo or copolymeric polycarboxylic acids or their salts in which the polycarboxylic acid includes at least two carboxylic radicals separated from each other by not more than two carbon atoms, citrates, succinates, and the like. Preferred builders include citrate builders, e.g., citric acid and soluble salts thereof, due to their ability to enhance detergency of a soap or detergent solution and their availability from renewable resources and their biodegradability.

A "thickener" or "viscosity modifier" may be used as an additional functional ingredient. Examples of thickeners or viscosity modifiers include acrylic acid polymers and copolymers, cellulosic and derivatized cellulosic polymers, purified clays, and alginates.

A "defoamer" may also be included as an additional functional ingredient. A defoamer includes any composition that suppresses or inhibits the formation of foam or controls it at a low level. Examples of defoamers include silicones, hydrophobically modified silica, and butyl, benyl and chloro capped ethoxylated alcohols.

A "pigment" or "dye" may be added as an additional functional ingredient. Examples of pigments and dyes include fluorecein, eosin red, and FD&C certified colors.

An "enzyme" may be added as an additional functional ingredient. Suitable enzymes include proteases, lipases, gluconases, cellulases, and amylases.

A "buffer" may be included as an additional functional ingredient. Suitable buffers include citrates, phosphates, borates, and carbonates.

Finally, a "solvent" may be included. Suitable solvents include propylene glycol, hexylene glycol, ethylene glycol, butylene glycol, isopropyl alcohol, ethylene alcohol, ethoxyphenol, butyl cellosolve, butyl carbitol, and methyl soy esters.

Method

The invention pertains to a method of low temperature cleaning of food and beverage plant equipment. Such equipment includes hard surfaces such as pipes, tanks, vats, elastomeric gaskets, glass, plastic surfaces, steel surfaces, aluminum surfaces, galvanized surfaces, brass surfaces, and the like. Plastic surfaces include surfaces composed of polyethylene, high density polyethylene, PVC, teflon, polycarbonate, polypropylene, and other plastics. The invention may be used as part of a clean-in-place (CIP) cleaning program. The invention preferably may be carried out in either a five or a three step method, but may include additional or fewer steps. In the five step method, the invention preferably includes optionally rinsing a surface with an initial rinse solution, washing a surface with a detergent wash solution, rinsing a surface with an intermediate rinse solution, applying an antimicrobial treatment solution, and rinsing a surface with a final rinse solution. In the three step method, the invention preferably includes optionally rinsing a surface with an initial rinse solution, washing a surface with an antimicrobial detergent wash solution, and rinsing a surface with a final rinse solution. In the three step method, the antimicrobial detergent wash step preferably includes an antimicrobial treatment solution. The antimicrobial treatment solution preferably is added toward the end of the antimicrobial detergent wash step but may be added at any time.

Rinsing a Surface with an Initial Rinse Solution

Both the five step method and the three step method may begin with an optional initial rinse step. The phrase "rinsing a surface with an initial rinse solution" refers to removal of gross soil from the equipment, generally with water but also with cleaning agents. The cleaning agents may be diluted or undiluted. For this step, and all rinse steps, the temperature is less important than the rinsing action in terms of achieving the desired results. Therefore, this step may be conducted at any temperature including ambient temperature or the temperature of the initial rinse solution. This step preferably lasts from 0 to 20 minutes, more preferably from 0 to 10 minutes, and most preferably from 2 to 5 minutes. This step may be carried out in bursts or a continuous manner by circulating, flooding, spraying, foaming or fogging of the initial rinse solution. The step may also be carried out by forming a two phase annular mist of initial rinse solution and air. During this step, the initial rinse solution used for cleaning may or may not be re-circulated but may go directly to the drain after passing through the processing equipment. Thus, the initial rinse solution may pass through the processing equipment one time or multiple times.

The term "initial rinse solution" refers to the solution used during the initial rinsing step. Although it is beyond the scope of the invention to discuss the particular formulations for the initial rinse solution chemistry, some non-limiting examples of the initial rinse solution ingredients include: water, a detersive agent, an antimicrobial agent, additional functional ingredients or mixtures thereof.

Washing a Surface with a Detergent Wash Solution or an Antimicrobial Detergent Wash Solution The phrase "washing a surface with a detergent wash solution or an antimicrobial detergent wash solution" refers to the circulation of a cleaning solution to remove substantially all soil from the internal surfaces of the equipment and to keep that soil suspended or dissolved. In the five step method, the optional initial rinse step is followed by washing with a detergent wash solution. In the three step method, the optional initial rinse step is followed by washing with an antimicrobial detergent wash solution. In order to prevent redeposition of suspended soils the detergent may contain appropriate ingredients to achieve this goal. This step may be conducted where the temperature of the detergent wash solution or antimicrobial detergent wash solution is up to about 150° F., preferably in the range of 40° F. to 150° F., preferably in the range of 40° F. to 105° F., and most preferably in the range of 70° F. to 105° F. Here, the detergent wash solution or antimicrobial detergent wash solution is brought into contact with the processing equipment. For example, the detergent wash solution or antimicrobial detergent wash solution may be brought into contact with the surface in bursts or a continuous manner by circulating, flooding, spraying or applied through foaming or fogging. The step may also be carried out by forming a two phase annular mist of the detergent wash solution or the antimicrobial detergent wash solution and air. The preferable cleaning time for the detergent wash step is from 5 to 60 minutes, more preferably from 10 to 45 minutes, and most preferably from 10 to 20 minutes.

The term "detergent wash solution" refers to the solution used during the detergent wash step of the five step method. The detergent wash solution preferably contains a sufficient amount of a detergent to remove soils. Although it is beyond the scope of this invention to discuss the particular formulations for the detergent wash solution chemistry, some non-limiting examples of detergent wash solution ingredients include: water, a detersive agent, an antimicrobial agent, additional functional ingredients, or mixtures thereof.

The detergent wash solution preferably maintains a pH in the range of 0–11, more preferably in the range of 1–10, and most preferably in the range of 1–7. In these pH ranges, gaskets are not significantly degraded and carbon dioxide from carbonated beverage product is not converted to sodium carbonate. Additionally, the detergents are preferably chemically compatible with the antimicrobial treatment solution. When the detergents are chemically compatible with the antimicrobial treatment solution, there is no need to eliminate all traces of detergents before commencing with the antimicrobial treatment step. The detergent wash step may optionally include the addition of an antimicrobial agent.

In one embodiment, the intermediate rinsing and the application of an antimicrobial treatment solution may be eliminated and the application of the antimicrobial treatment solution may occur during an antimicrobial detergent wash step of the three step inventive method. In this embodiment, an antimicrobial treatment solution may be added during the antimicrobial detergent wash step. The cleaning time for the antimicrobial detergent wash step is preferably from 5 to 60 minutes, more preferably from 10 to 45 minutes, and most preferably from 10 to 20 minutes.

The phrase "antimicrobial detergent wash solution" refers to the solution used during the antimicrobial detergent wash step of the three step method. Although it is beyond the scope of this invention to discuss the particular formulations for the antimicrobial detergent wash solution chemistry, some non-limiting examples of antimicrobial detergent wash solution ingredients include: water, a detersive agent, an antimicrobial agent, additional functional ingredients, or mixtures thereof. The antimicrobial detergent wash solution preferably contains an active antimicrobial agent at a pH where said agent is active. The active antimicrobial agent is preferably present in the antimicrobial detergent wash solution and therefore present on a surface from 30 seconds to 30 minutes, more preferably from 30 seconds to 10 minutes, and most preferably from 30 seconds to 7 minutes.

When the antimicrobial agent is added to the antimicrobial detergent wash step, the antimicrobial agent is preferably added toward the end of the detergent wash cycle. In this embodiment, the antimicrobial detergent wash step may be followed by the final rinse step.

Rinsing a Surface with the Intermediate Rinse Solution

The phrase "rinsing a surface with the intermediate rinse solution" refers to a rinse to remove soil and detergent solution from the surface that is being cleaned. During this step, the intermediate rinse solution may pass through the processing equipment one time or multiple times before going directly to the drain. The intermediate rinse solution may be brought into contact with the processing equipment in bursts or a continuous manner by circulating, flooding, spraying, foaming or fogging. The step may also be carried out by forming a two phase annular mist of intermediate rinse solution and air. Again, the temperature of the solution is less important than the rinsing action in terms of achieving the desired results. Therefore, this step may be conducted at any temperature including ambient temperature or the temperature of the intermediate rinse solution, or the temperature of the intermediate rinse solution is up to 80° F. This step preferably lasts from 0 to 20 minutes, more preferably from 0 to 5 minutes, and most preferably from 0 to 2 minutes.

The term "intermediate rinse solution" refers to the solution used during the intermediate rinsing. Although it is beyond the scope of this invention to discuss particular formulations for the intermediate rinse solution chemistry, some non-limiting examples of intermediate rinse solution ingredients include: water, a detersive agent, an antimicrobial agent, additional functional ingredients, a soil if the intermediate rinse solution is a recycled rinse solution from a previous rinse, or mixtures thereof. The intermediate rinse solution is preferably water.

Applying an Antimicrobial Treatment Solution to a Surface

The phrase "applying an antimicrobial treatment solution to a surface" refers to substantially wetting the surface with an aqueous solution that has antimicrobial properties. The temperature of the antimicrobial treatment solution may be up to about 150° F., preferably in the range of 40° F. to 150° F., preferably in the range of 40° F. to 105° F., and most preferably in the range of 70° F. to 105° F. During this step, the antimicrobial treatment solution may be brought into contact with the processing equipment in bursts or in a continuous manner by circulating, flooding, spraying, foaming or fogging. The step may also be carried out by forming a two phase annular mist of antimicrobial treatment solution and air. The duration of this step is preferably from 30 seconds to 30 minutes, more preferably from 30 seconds to 15 minutes, and most preferably from 5 minutes to 15 minutes.

The term "antimicrobial treatment solution" refers to the solution used during the antimicrobial treatment step. Although it is beyond the scope of this invention to discuss particular formulations for the antimicrobial treatment solution chemistry, some non-limiting examples of antimicrobial treatment solution ingredients include: water, a detersive agent, an antimicrobial agent, additional functional ingredients, or mixtures thereof. The antimicrobial treatment solution preferably contains an antimicrobial agent at a pH where the agent is active.

Rinsing a Surface with a Final Rinse Solution

The phrase "rinsing a surface with a final rinse solution" refers to a potable rinse that substantially removes either the antimicrobial agent or the antimicrobial detersive agent. As previously stated, the temperature is less important than the rinsing action in terms of achieving the desired results. Therefore, this step may be conducted at any temperature including ambient temperature or at the temperature of the final rinse solution. This step preferably lasts from 30 seconds to 20 minutes, more preferably from 30 seconds to 15 minutes, and most preferably from 30 seconds to 10 minutes. The duration is preferably sufficient to remove remaining traces of soil, cleaners, or antimicrobial treatment solutions and pass an olefactory test. An olefactory test involves collecting a sample of the final food or beverage in a sterile container and smelling and tasting it for established criteria. The final rinse solution may be brought into contact with the processing equipment in bursts or in a continuous manner by circulating, flooding, spraying, foaming or fogging. The step may also be carried out by forming a two phase annular mist of final rinse solution and air. The final rinse solution may pass directly to the drain. During the final rinse, the final rinse solution may be circulated through the processing equipment. The final rinse solution is preferably circulated through the processing equipment one time, but may be circulated more than one time.

The term "final rinse solution" refers to the solution used during the final rinse. Although it is beyond the scope of this invention to discuss particular formulations of the final rinse solution chemistry, some non-limiting examples of final rinse solution ingredients include: sterile water and treated water utilized to make a beverage or processed beverage. Sterile water means water that does not contain any viable microorganisms. Treated water utilized to make a beverage or processed beverage means water that has undergone a treatment process to reduce its hardness, alkalinity and microbial count. Such water has also undergone an antimicrobial treatment; after an appropriate retention time the antimicrobial agent is removed by carbon bed filtration. Such water frequently undergoes a final treatment by ultraviolet light. The final rinse solution preferably contains chlorine dioxide, chlorine, or ozone. When chlorine dioxide, chlorine or ozone are included in the final rinse solution, they are present up to 1.0 ppm.

For a more complete understanding of the invention, the following examples are given to illustrate some embodiments. These examples and experiments are to be understood as illustrative and not limiting. All parts are by weight, except where it is contrarily indicated.

EXAMPLES

Coupon Preparation

The elastomeric coupons used for micrographs, sanitizing and sanitation studies were prepared by cutting 1"×1" squares from test sheets purchased from C&C Packagers, White Bear Lake, Minn. The stainless steel coupons were prepared by cutting squares from test sheets purchased from Metal Samples, Munford, Ala. Both coupons were treated as follows:

185° F. water —12 squares were placed in ajar containing 1 liter of water, the jar was covered and placed in a 185° F. oven for 14 days.

185° F. Bevrosheen (a caustic detergent, pH 13, available from Ecolab Inc.)—12 squares were placed in a jar containing 3.5 ml of Bevrosheen and 1 liter of water, the jar was covered and placed in a 185° F. oven for 14 days. The pH was adjusted to 13 every 2–3 days with NaOH.

104° F. phosphoric acid and citric acid (pH 2.3)—12 squares were placed in a jar containing 2.3 ml of a mixture of phosphoric acid, citric acid and surfactants and couplers and 1 liter of water, the jar was covered and placed in a 104° F. oven for 14 days. The pH was adjusted to 2.3 every 2–3 days with phosphoric acid.

104° F. pH 2.3—12 squares were placed in a jar containing 1 liter of water. The pH was adjusted with phosphoric acid and the jar was covered and placed in a 104° F. over for 14 days. The pH was adjusted to 2.3 every 2–3 days with phosphoric acid.

185° F. pH 13–12—12 squares were placed in ajar containing 1 liter of water. The pH was adjusted with NaOH and the jar was covered and placed in a 185° F. oven for 14 days. The pH was adjusted to 13 every 2–3 days with NaOH.

Antimicrobial Treatment Test Method

The purpose of this test was to evaluate the antimicrobial efficacy of sanitizers on pre-cleaned inanimate, non-porous surfaces. The method is a modification of the ASTM E 1153–87 standard. It compared the efficacy of various chemical sanitizers on pre-cleaned inanimate, non-porous surfaces in order to simulate antimicrobial efficacy against *Lactobacillus malefermentans* (ATCC 11305) and a yeast-mold isolate (⅓ black fungal isolate, ⅓ gray fungal isolate, and ⅓ *Yarrowia lipolytica* isolated from a beverage plant) on beverage processing equipment.

The bacteria were incubated on Tryptone Glucose Extract Agar at 37±2° C. for 48±4 hours or until sufficient growth. The yeast-mold isolate was incubated on Sabouraud's Dextrose Agar at 20–25° C. for 48±4 hours. Three sterile squares of either the stainless steel or the elastomer were then inoculated with the bacteria. Vortexx™ (a mixture of peroxyacetic acid and octanoic acid available from Ecolab Inc.) was applied to one square at 75° F., Chlorine was applied to a second square at 75° F. and water was applied to a third square at 185° F. After five minutes, the squares were placed in a neutralizer solution of 0.5% sodium thiosulfate to suspend surviving organisms. The neutralizer solution was then plated on Tryptone Glucose Extract Agar for the bacteria and Sabouraud's Dextrose Agar for the yeast-mold isolate and in order to determine the number of surviving organisms.

Coupon Testing for Bio-Load Removal Study

Four sets of elastomer coupons were pre-conditioned: a virgin set (no chemical treatment), a 185° F. water treated set (current industry practice), a 185° F., 0.5% Bevrosheen set (current industry practice), and a 104° F., 0.23% acidic detergent (mixture of phosphoric acid, citric acid and surfactants and couplers) set (inventive sanitation program). The same yeast-mold isolates as in the antimicrobial treatment method were grown up for inoculation onto the coupons. The coupons were inoculated with the isolates. The coupons were then subjected to the inventive five step method involving an initial rinse step, a detergent wash step, an intermediate rinse step, an antimicrobial treatment step, and a final rinse step. The coupons were first placed in 1000 ml of ambient water for 10 minutes. The coupons were then placed in 1000 ml of a wash solution for 60 minutes. The coupons were then placed in a 2600 ppm solution Vortexx™ at 40° C. for 15 minutes. Finally, the coupons were placed in a jar containing sterile water. The carriers were than placed in 25 ml of 0.5% sodium thiosulfate neutralizing solution to suspend any surviving organisms. The neutralizing solution was then filtered and plated on Sabouraud's Dextrose Agar in order to determine the number of surviving organisms.

Examples 1–3

TABLE 1

Efficacy Against *Lactobacillus malefermentans* 5-min Contact-Time at Room Temperature

| Substrate/Carrier | | | Inoculum Control | Sanitizer Treatment | | |
|---|---|---|---|---|---|---|
| | | | Total Average | 0.26% Vortexx | 50 ppm Chlorine | 185 F. Water |
| Material | Chemical Treatment (Corrosion) | Trial | Initial Population* | Filter Survivors (CFU/ml) | Filter Survivors (CFU/ml) | Filter Survivors (CFU) |
| BUNA N | pH 2.3 | 1 | 1.0E+03 | <1 | <1 | <1 |
| | Phosphoric Acid | 2 | | <1 | <1 | <1 |
| | 104 F., 2 weeks | 3 | | <1 | <1 | <1 |
| BUNA N | pH 13 | 1 | 9.7E+01 | <1 | <1 | <1 |
| | Caustic | 2 | | <1 | <1 | <1 |
| | 185 F., 2 weeks | 3 | | <1 | <1 | <1 |
| Silicon Rubber | pH 2.3 | 1 | 1.6E+02 | <1 | <1 | <1 |
| | Phosphoric Acid | 2 | | <1 | <1 | <1 |
| | 104 F., 2 weeks | 3 | | <1 | <1 | <1 |
| Silicon Rubber | pH 13 | 1 | 1.1E+02 | <1 | <1 | <1 |
| | Caustic | 2 | | <1 | <1 | <1 |
| | 185 F., 2 weeks | 3 | | <1 | <1 | <1 |
| Stainless Steel | None | 1 | 1.1E+02 | <1 | <1 | <1 |
| | | 2 | | <1 | <1 | <1 |
| | | 3 | | <1 | <1 | <1 |

*Average of 2 plates

Table 1 compares the efficacy of three sanitizer treatments against *Lactobacillus malefermentans:* 185° F. water, chlorine, and 0.26% Vortexx™ at 104° F. (inventive method). These three sanitizer treatments were tested on five preconditioned coupons: (1) a BUNA N coupon preconditioned for two weeks with phosphoric acid (pH 2.3) at 104° F.; (2) a BUNA N coupon preconditioned for two weeks using caustic (pH 13) at 185° F.; (3) a silicon rubber coupon preconditioned for two weeks with phosphoric acid (pH 2.3) at 104° F.; (4) a silicon rubber coupon preconditioned for two weeks using caustic (pH 13) at 185° F.; and (5) a stainless steel coupon that was not preconditioned. Three trials were run with each type of coupon. In each case, the population of *Lactobacillus malefermentans* was reduced to <1 CFU/ml.

Table 1 shows that ambient sanitizing of the invention is as effective as the industry standard, 185° F. water, on stainless steel and chemically corroded elastomers that have been loaded with the spoilage bacteria *Lactobacillus malefermentans*. A log reduction of 2–3 log reduction is considered to be an acceptable level of sanitation. In this case a log reduction of 2 to 3 was achieved when Vortexx™, chlorine, and 185° F. water were used. Therefore, the inventive method is as effective as the current industry standard at reducing the population of bacteria on a variety of surfaces.

TABLE 2

| Efficacy on Yeast-Mold Isolate - 15 Minute Contact-Time | | | | | | | | | | | |
|---|---|---|---|---|---|---|---|---|---|---|---|
| Substrate/Carrier | | | Inoculum Control | 0.26% Vortexx 104 F. | | | | 185 F. Water | | | |
| Material | Chemical Treatment (Corrosion) | Trial | Total Average Initial Population* | Survivors* (CFU/ml) | Survivors* (CFU/sq) | Percent Reduction | Filter Survivors (CFU) | Survivors* (CFU/ml) | Survivors* (CFU/sq) | Percent Reduction | Filter Survivors (CFU) |
| Stainless Steel | None | 1 | 8.2E+04 | <1 | <25 | >99.9 | <1 | <1 | <25 | >99.9 | <1 |
| | | 2 | | <1 | <25 | >99.9 | <1 | <1 | <25 | >99.9 | <1 |
| | | 3 | | <1 | <25 | >99.9 | <1 | <1 | <25 | >99.9 | <1 |

*Average of 2 plates per carrier

Figure 2:
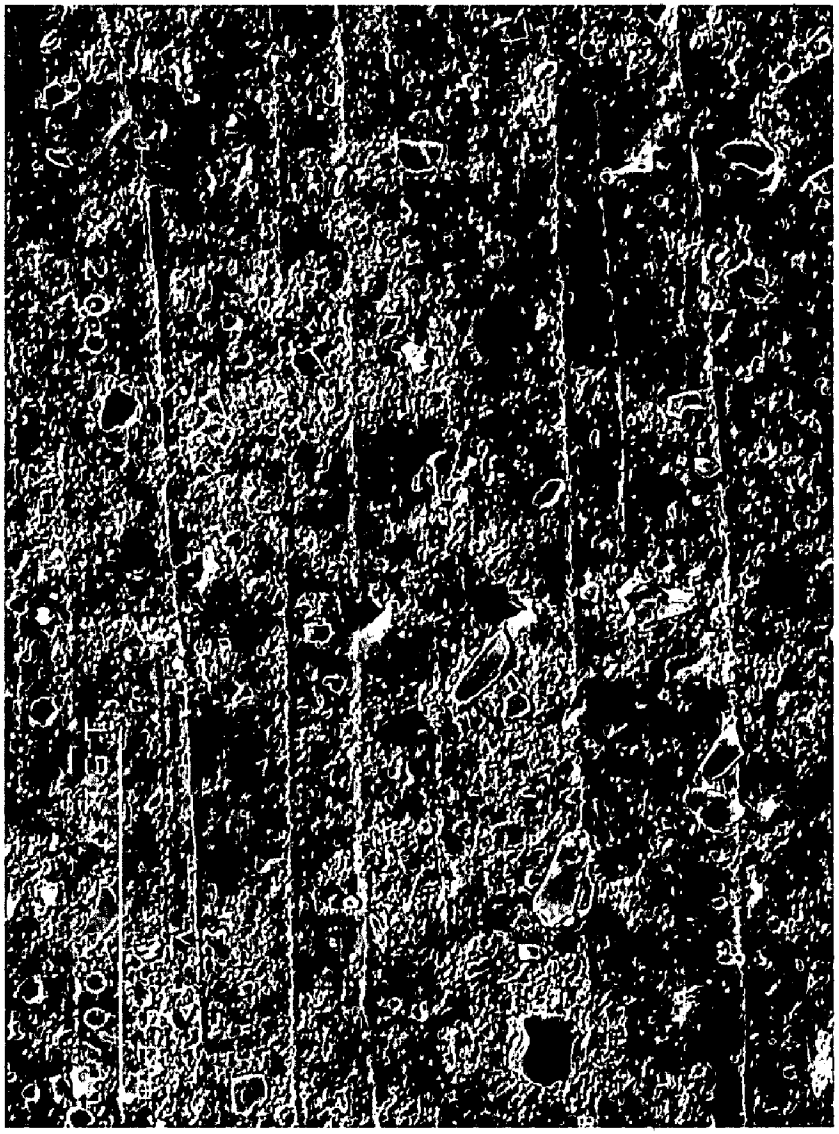
FIG. 2 is an electron micrograph of an elastomer coupon subjected to a pH of 2.3 at 104° F. for two weeks.

In Table 2, the efficacy of 185° F. water and 0.24% Vortexx at 104° F. against a yeast-mold isolate was compared. These two sanitizer treatments were compared on a stainless steel coupon that was not preconditioned. Table 2 shows that low temperature sanitizing of the invention is as effective as the industry standard, 185° F. water, on stainless steel coupons that have been loaded with a typical beverage plant yeast/mold isolate. Again, a log reduction of 2–3 is considered to be an acceptable level of sanitation. Here a log reduction of 3 was achieved with both the inventive method, and the current industry standard showing that the inventive method is as effective as the current industry standard.

conditions. FIG. 1 shows the surface deformation of the elastomer using current industry standards. FIG. 2 shows the absence of such deformation using the cleaning method of the invention.

Example 4

This example illustrates the utility of the invention. Table 4 shows survivors after being treated with the 5-step method described under Coupon Testing for Bio-Load Removal Study. The yeast-mold isolates described under the Antimicrobial Treatment Test Method were grown up on silicon

TABLE 3

| Yeast-Mold Isolate - 15-Minute Contact-Time | | | | | | | | | |
|---|---|---|---|---|---|---|---|---|---|
| Substrate/Carrier | | | Inoculum Control | 0.26% Vortexx | | | | | |
| | Chemical | | Total Average | Room Temperature | | | 185 F. Water | | |
| Material | Treatment (Corrosion) | Trial | Initial Population* | Survivors* (CFU/ml) | Survivors* (CFU/sq) | Percent Reduction | Survivors* (CFU/ml) | Survivors* (CFU/sq) | Percent Reduction |
| BUNA N | pH 2.3 | 1 | 4.8E+03 | 4 | 1.0E+02 | 98.0 | <1 | <25 | >99.5 |
| | Phosphoric Acid | 2 | | 8.5 | 2.1E+02 | 95.7 | <1 | <25 | >99.5 |
| | 104 F., 2 weeks | 3 | | 6.5 | 1.6E+02 | 96.7 | <1 | <25 | >99.5 |
| BUNA N | pH 13 | 1 | 1.1E+04 | 260 | 6.5E+03 | 35.0 | <1 | <25 | >99.8 |
| | Caustic | 2 | | 350 | 8.8E+03 | 12.0 | <1 | <25 | >99.8 |
| | 185 F., 2 weeks | 3 | | 185 | 4.6E+03 | 54.0 | <1 | <25 | >99.8 |

*Average of 2 plates per carrier

Table 3 compares the efficacy of 0.26% of Vortexx at room temperature and 185° F. water against a yeast-mold isolate. The isolate was loaded on two coupons: (1) a BUNA N coupon pre-treated with phosphoric acid (pH 2.3) at 104° F. for two weeks; and (2) a BUNA N coupon pre-treated with caustic (pH 13) at 185° F. for two weeks. Table 3 shows the efficacy of the Vortexx sanitizer with the inventive method was significantly greater on the elastomeric coupons subjected to 104° F., low-pH cleaning solutions of this invention for extended periods of time, than on those that were subjected to the 185° F., high caustic cleaning solutions that are typically employed in the industry. While not wanting to be held to any scientific theory as to why the inventive method is more effective on coupons pretreated with the inventive method as opposed to the industry standard, this is believe to be due to the more corrosive, high-temperature, high pH conditions causing surface deformation of the elastomer, and therefore, providing a harborage against attack from the sanitizing agent, making it more difficult to clean. FIGS. 1 and 2 are electron micrographs comparing the surfaces of two elastomer gaskets subjected to these two rubber coupons that had been pre-treated as follows: (1) virgin, untreated surface; (2) 185° F. water; (3) 185° F. Bevrosheen; and (4) 104° F. acidic detergent (a mixture of phosphoric acid, citric acid and surfactant and coupler). The yeast/mold isolates that were grown up on 185° F. water treated (two weeks) silicon rubber substrates were more difficult to remove and kill than those that were grown up on the silicon rubber substrates that were subjected to the methods that are described in this disclosure. Specifically, the coupon that was pretreated with 185° F. water only showed a 1 log reduction in the yeast-mold isolates after being subjected to the 5-step method of the invention. Again, while not wanting to be held to any scientific theory, this is believed to be due to the more corrosive, high-temperature conditions causing surface deformation of the elastomer and therefore providing a harborage against attack from the sanitizing agent, making it more difficult to clean. When the coupon was pretreated with 185° F. Bevrosheen, a log reduction of 3 was achieved suggesting that the combination of the temperature with the chemical is more effective than the 185° F. water alone, even on coupons that have surface deformation. The inventive method (104° F. low pH) demonstrated a log reduction of 3 showing that the inventive method is at least better that 185° water without chemicals and as effective as 185° Bevrosheen (high pH).

TABLE 4

Yeast/Mold Isolate Survivors After Sanitation Program on Virgin and Chemically Treated Silicon Rubber Carrier

| Virgin Coupon | | 185° F. Water Treated Coupon | | 185° Bevrosheen Treated Coupon | | 104° F. Acidic Detergent (a mixture of phosphoric acid, citric acid, and surfactant and coupler) Treated Coupon | |
|---|---|---|---|---|---|---|---|
| Initial Inoculum (cfu avg of 2) | Percent Reduction (avg of 3)* | Initial Inoculum (cfu avg of 2) | Percent Reduction (avg of 3)* | Initial Inoculum (cfu avg of 2) | Percent Reduction (avg of 3)* | Initial Inoculum (cfu avg of 2) | Percent Reduction (avg of 3)* |
| 3.4E+04 | 99.9 3 log reduction | 6.0E+04 | 38.3 <1 log reduction | 4.0E+04 | 99.9 3 log reduction | 4.4E+04 | 99.9 3 log reduction |

*all carriers had less than 25 cfu survivors

Example 5

Figure 3:
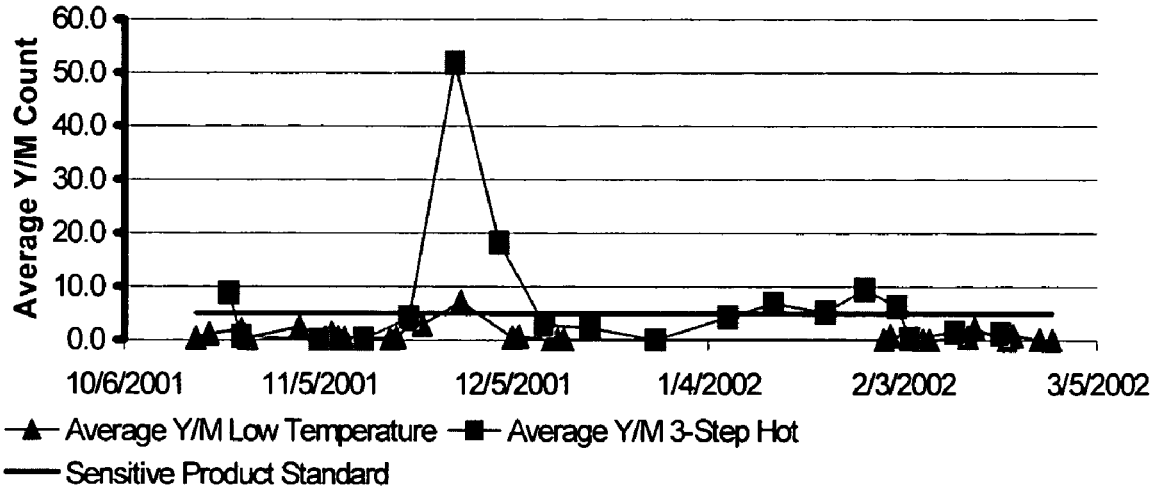
FIG. 3 is a graph comparing the low temperature cleaning method of the invention to the current industry standard (185° F. with 0.5% sodium hydroxide).

FIG. 3 depicts the field test results at a customer's beverage plant. When the customer's production schedule allowed testing of the inventive method, the five step method was tested on beverage lines running carbonated beverages. When the customer's production schedule did not allow for testing of the inventive method, i.e. when the customer was running a sensitive beverage such as a juice on the beverage line, the customer used the standard 3-step high alkaline method at 185° F. with 0.5% sodium hydroxide. The customer's beverage plant equipment was stainless steel.

The five step method began with the initial rinse step at ambient temperature for five minutes. Next, the appropriate concentration of the detergent wash solution was determined and the detergent wash solution was heated to 100° F. to 108° F. The detergent wash solution was 0.23% to 0.56% acidic detergent (a mixture of phosphoric acid, citric acid, surfactant and coupler). The detergent wash step was then conducted for 10 minutes. Following the detergent wash step the system was drained and then rinsed with an intermediate rinse solution for 5 minutes. The intermediate rinse solution was allowed to rinse into the drain. Following the intermediate rinse, the antimicrobial treatment solution concentration was determined and the antimicrobial treatment step was conducted. The antimicrobial treatment solution was a 0.13% to 0.26% Vortexx™ solution (pH 2.5–3.5). The temperature of the antimicrobial treatment solution was ambient temperature. The antimicrobial treatment step lasted for 15 minutes. Following the antimicrobial treatment step, the antimicrobial treatment solution was drained and the final rinse step was completed for 10 minutes. The final rinse solution was allowed to rinse into the drain. Following the final rinse step, the entire system was drained.

FIG. 3 shows that the inventive program provided the lowest plate-counts on average with the fewest points above the customer's standard for sensitive products, <5 cfu per 100 ml of final rinse water as compared to the industry standard 3-step method with 0.5% sodium hydroxide at 185° F. Overall the inventive method produced, on average, the lowest total microorganism counts, clean appearance of equipment, and most acceptable product during the trial period according to the customer's olefactory tests.

Example 6

As stated previously, cleaning under a carbon dioxide atmosphere presents unique problems due to dissolved carbon dioxide. The carbonic acid, which in the presence of sodium hydroxide from a caustic detergent for instance, forms sodium carbonate ($Na_2CO_3$). When the solubility limit of the sodium carbonate is exceeded in the solution, a precipitate forms.

Figure 4:
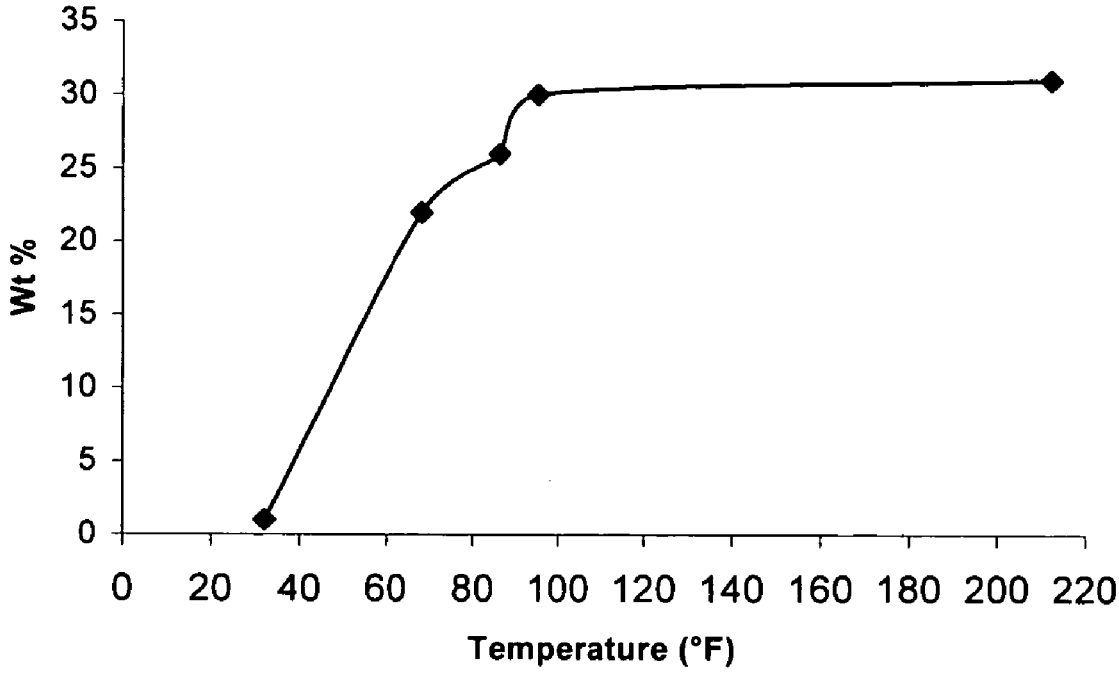
FIG. 4 is a graph of the solubility of sodium carbonate as the temperature increases.

FIG. 4 shows the solubility of sodium carbonate as a function of temperature. It is evident from the chart that the solubility of sodium carbonate increases dramatically with temperature until about 105° F. At this temperature, a further increase in temperature does not appreciably increase the solubility of sodium carbonate.

TABLE 5

Carbon Dioxide Absorption Experiment

| Time (min) | ($CO_2$ Generation Rate) ml 9N $H_2S0_4$ Reacted with Sodium Bicarbonate | ppm $CO_2$ in Wash Solution | pH | Comments |
|---|---|---|---|---|
| 0.0 | 0.0 | 35.0 | 10.5 | No change in appearance/no ppt |
| 5.0 | 3.5 | 70.0 | 5.6 | No change in appearance |
| 10.0 | 6.7 | 105.0 | 5.3 | No change in appearance |
| 20.0 | 10.0 | 245.0 | 5.0 | No change in appearance |
| 30.0 | 13.5 | 245.0 | 5.0 | No change in appearance |
| 60.0 | 19.5 | 210.0 | 5.1 | No change in appearance |
| 150.0 | 35.0 | 210.0 | 5.0 | No change in appearance |

Table 5 shows the results of a room temperature carbon dioxide absorption experiment that was run on a 0.25% solution of a basic detergent (a mixture of potassium hydroxide, potassium carbonate and surfactant). Carbon dioxide was bubbled in from a generator (acid plus bicarbonate) and the pH immediately dropped due to the initial formation of bicarbonate and finally carbonate. After about 30 minutes of carbon dioxide bubbling, the solution held about all the carbonate and no precipitate was formed.

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A method of cleaning and applying an antimicrobial treatment to a surface of food and beverage equipment comprising at least the following steps in sequential order:

a. washing said surface with a detergent wash solution comprising an acidic detersive agent wherein the temperature of the detergent wash solution ranges from 100° F. to 150° F.;

b. rinsing said surface with an intermediate rinse solution, wherein the temperature of the intermediate rinse solution is up to about 80° F.; and c. applying an antimicrobial treatment solution to said surface, the antimicrobial treatment solution comprising an active antimicrobial agent, wherein the temperature of the antimicrobial treatment solution is up to about 150° F., wherein the active antimicrobial agent is selected from the group consisting of a percarboxylic acid, a halogen composition, a halogen donor composition, chlorine dioxide, ozone, a quarternary ammonium compound, an acid-anionic organic sulfonate, an acid-anionic organic sulfate, a protonated carboxylic acid, and mixtures thereof.

2. The method of claim 1, wherein the method further comprises rinsing said surface with an initial rinse solution prior to washing with said detergent wash solution.

3. The method of claim 1, wherein the detergent wash solution contains an antimicrobial agent.

4. The method of claim 1, wherein the detergent wash solution maintains a pH of 1–7 during the washing.

5. The method of claim 1, wherein the antimicrobial treatment solution provides greater than a 2-log order reduction in the population of microorganisms.

6. The method of claim 2, wherein the temperature of the initial rinse solution is up to about 80° F.

7. The method of claim 2, wherein the method further comprises rinsing said surface with a final rinse solution following application of the antimicrobial treatment solution.

8. The method of claim 2, wherein the initial rinse solution is selected from the group consisting of water, a detersive agent, an antimicrobial agent, or mixtures thereof.

9. The method of claim 7, wherein the temperature of the final rinse solution is up to about 80° F.

10. The method of claim 7, wherein the final rinse solution comprises water.

11. The method of claim 10, wherein the final rinse solution further comprises chlorine dioxide, ozone, or chlorine.

* * * * *